United States Patent [19]

Buchholz et al.

[11] Patent Number: 4,529,492

[45] Date of Patent: Jul. 16, 1985

[54] PROCESS FOR THE COATING OF HOLLOW BODIES OPEN ON ONE SIDE

[75] Inventors: Horst Buchholz, Wuppertal; Gerhard F. Ottmann, Solingen; Hans-Peter Patzschke, Wuppertal, all of Fed. Rep. of Germany

[73] Assignee: Herberts Gesellschaft mit beschraenkter Haftung, Wuppertal, Fed. Rep. of Germany

[21] Appl. No.: 629,566

[22] Filed: Jul. 10, 1984

[30] Foreign Application Priority Data

Jul. 12, 1983 [DE] Fed. Rep. of Germany ..... 3325068

[51] Int. Cl.[3] ..... C25D 13/04; C25D 13/14

[52] U.S. Cl. ..... 204/180.2; 204/300 EC; 204/181.6; 204/181.7; 204/180.7

[58] Field of Search ..... 204/181 R, 181 C, 300 EC

[56] References Cited

U.S. PATENT DOCUMENTS

| | | | |
|---|---|---|---|
| 2,215,166 | 9/1940 | Sumner et al. | 204/181 R |
| 3,483,907 | 12/1969 | Bush et al. | 204/181 R |
| 3,585,120 | 6/1971 | Wehrmann et al. | 204/181 R |
| 3,620,952 | 11/1971 | Chiappe | 204/300 EC |
| 3,660,266 | 5/1972 | Koch, II et al. | 204/300 EC |
| 3,694,336 | 9/1972 | Fiala | 204/300 EC |
| 3,801,485 | 4/1974 | Kossmann | 204/300 EC |
| 3,849,284 | 11/1974 | Kossmann | 204/181 R |
| 3,922,213 | 11/1975 | Smith et al. | 204/181 R |
| 4,094,760 | 6/1978 | Smith et al. | 204/300 EC |
| 4,107,016 | 8/1978 | Brower, Jr. et al. | 204/181 R |
| 4,210,507 | 7/1980 | Davidson et al. | 204/300 EC |
| 4,400,251 | 8/1983 | Heffner et al. | 204/300 EC |

*Primary Examiner*—Howard S. William
*Assistant Examiner*—Terryence Chipman
*Attorney, Agent, or Firm*—Schwartz, Jeffery, Schwaab, Mack, Blumenthal & Evans

[57] ABSTRACT

The coating of hollow bodies open on one side, such as cans, with paints such as clear or pigmented lacquers, enamels or the like give rise to difficulties for a continuous one-step operation. In the coating process, the cans are first washed, then coated inside and outside, dried and optionally printed and again dried. The difficulties of a continuous one-step operation are solved by utilizing an electro-dipcoating bath and by employing a process wherein the cans are immersed in the electro-dipcoating bath vertically and with the closed bottom downward into the bath, filled from the top with the bath liquid and during the raising from the bath, tilted so that their opening is pointing downward. The cans may also be forcibly immersed with their opening below the surface of the bath for filling with the bath liquid by means of a filler device. Uniform coatings of a plurality of hollow bodies in a continuous one-step coating process are thereby achieved.

14 Claims, No Drawings

PROCESS FOR THE COATING OF HOLLOW BODIES OPEN ON ONE SIDE

BACKGROUND OF THE INVENTION

1. Field of the Invention

The invention relates to a process for the coating of hollow bodies open on one side, such as the coating of metal cans or the like, wherein the individual hollow bodies are washed, coated inside and out, dried, optionally printed, again dried and subsequently beaded at the open end.

2. Background of the Art

The increasingly severe environmental protection regulations concerning lacquering processes make consideration of the electro-dipcoating process worthwhile for introduction in the can-making industry in the form of a fully automatic coating process. It is known to coat can bodies open on both sides for three-part cans or a weld seam electrophoretically by immersion in an electro-dipcoating bath. U.S. Pat. No. 3,694,336 and West German Offenlegungsschrift No. 2116715 are illustrative of this process. The bodies are easily handled in this known procedure, as they have no bottoms and the liquid of the bath can enter without hindrance and run off after the coating again without problems.

Hollow bodies closed on one end, such as cans with bottoms, cannot be coated electrophoretically in a simple manner as is necessary in order to obtain a uniform coating. The air in the hollow body must be allowed to escape completely. For this reason, the machine building industry has developed special methods to effect the process in steps. In other words, the coating is applied in individual, successive steps, for example, on the inside first. The means known for this purpose have certain common features. Thus, the cans are held at the bottom for the internal coating, while simultaneously establishing the necessary electrical contacts. A counter electrode is inserted in the can from the open side. This counter electrode must be located at a slight distance of 0.25 to 5 mm from the inner wall of the can. Thus, the shape of the electrode must be adapted very accurately to that of the can. In view of the complicated configuration of the corresponding apparatus, the cans must be coated individually in succession so that only very short coating times of 10 to 500 msec. are available if a high production rate is desired. In closed systems, for example in a vertical layout (European Pat. Nos. 50,045; 19,669; British Pat. No. 1,117,831; U.S. Pat. 3,922,213 and West German Offenlegungsschrift No. 2929570) the liquid must be pumped at high velocities in order to apply the electro-dipcoating liquid and a water rinse within short periods of time and to exhaust the gases formed during the electro-dipcoating process. Oxygen or hydrogen gases are formed depending on polarization. In open systems, the cans arranged in an approximately horizontal position must be rotated to obtain uniform coating as shown in West German Offenlegungsschrift No. 2633179 and U.S. Pat. No. 4,107,016. There is also a high risk of contamination in the blowing of the cans.

The disadvantage of these known configurations include the fact that the cans must be coated individually in succession, thereby requiring a great mechanical effort. The space needed for the apparatus almost renders an economic mass production impossible. Internal electrodes can be inserted with adequate fitting accuracy only in cans with straight and smooth walls, i.e., can shapes other than cylindrical lead to severe difficulties. Because of the slight distance of the internal electrode to the wall of the can, there is a danger of electrical shorts and flash-overs in zones of high current density. Correspondingly, coatings with a low layer resistivity must be used in order to be able to apply the coating with low electric voltages without interference in the short period of time available.

SUMMARY OF THE INVENTION

It is an object of the invention to simplify the coating of hollow bodies open on one end, so that they may be coated in a single, continuous work step, both inside and out.

The invention makes it possible to coat hollow bodies open on one end, such as metal cans having a bottom, in a single work step, simultaneously inside and outside, drying immediately and optionally printing or labelling. The mechanical effort and the space requirements are relatively low so that an economic operation is feasible. For example, up to 16 cans may be passed simultaneously, i.e., adjacent to each other, through an electro-dipcoating bath and coated therein.

The cut or uncut cans are forced vertically douwnward into the electro-dipcoating vessel, according to the invention, i.e., the bottom of the cans face downwardly into the electro-dipcoating vessel. For more rapid and advantageous coating, a filling means is inserted into the cans for filling the inside with the bath liquid. In the course of their transport through the electro-dipcoating vessel, the cans are either immersed below the surface of the bath or, especially in the case of uncut cans, guided advantageously so that the can opening is located above the surface of the bath liquid. For raising the cans from the immersion bath, the cans are tilted so that their opening is downward, thereby completely draining the liquid from the cans.

The transport element may be an endless conveyor belt or an endless chain from which the cans are suspended practically vertically or upon which they are standing, i.e., the transport belt may travel above the surface of the bath or it may pass through the electro-dipcoating immersion bath.

DETAILED DESCRIPTION OF THE INVENTION

As the hollow bodies are passed through an immersion bath, adequately long coating times are obtained. It is, therefore, possible to guide several hollow bodies simultaneously through the bath and obtain even, high quality coatings in mass production with high flow rates. Thus, for example with a coating time of 1 to 120 seconds, a pigmented or unpigmented coating may be applied electrophoretically, using a DC current, wherein the wet film deposited on the hollow body has a layer resistance of at least $0.6\times10^8$ Ohm.cm.

The hollow bodies to be coated are connected by means of the holding means as the anode, if an anionic electro-dipcoating medium is used, and as the cathode, if a cationic electro-dipcoating medium is being applied. The counter electrode is always at a distance from the hollow bodies in the immersion bath. The internal coating is effected, depending on the configuration, by means of a so-called wrap-around, which effects the coating on the basis of its optimally high insulating effect in the film deposited, or with the aid of an internal electrode introduced in the can.

In order to obtain the greatest possible wrap-around, a series of factors must be taken into consideration in the development of the coating. The electrophoretic coating is effected by initially coating the wall opposite the counter electrode, i.e., the outside wall of the hollow body. The wet film initially insulates the outside wall during the gradual deposition onto the wall. The electrical field lines then migrate into the inside of the hollow body where the deposition continues. The time of deposition and the insulating effect of the material characterized by the layer resistance must be correlated in order to obtain good wrap-around.

The longer the coating time, the higher the layer resistance will be, due to the increase in layer thickness and to electro-osmotic processes required for the reduction of the content in neutralizing agents or for electrochemical dehydration. The lower limit of the coating time should, therefore, be more than 3 seconds, in particular 5 seconds and, particularly appropriately, more than 10 seconds. The upper limit is determined by the length of the immersion bath, the transport velocity, and the number of hollow bodies to be processed. In order to achieve an economically acceptable measure, the upper limit should be approximately less than 60 seconds and, preferably, less than 30 seconds of coating time. The quantity of film applied depends on the precipitation voltage, which is between 50 and 400 volts. With increasing potentials, wrap-around increases. In order to prevent electric breakthroughs, either the voltage is maintained constantly high or a short prevoltage is used, i.e., prior to the coating itself voltages of less than 100 volts are applied for 0.1 to 0.5 seconds.

The wet film resistance required for good insulation should be in principle as high as possible. Its lower limit is, however, restricted by the short coating time desired. Thus, the lower limit should be at least $1\times10^8$ Ohm.cm, appropriately more than $1.5\times10^8$ Ohm.cm, and preferably, higher than $2\times10^8$ Ohm.cm. The higher the layer resistance, the thinner the layer that may be obtained on the wall of the can. The upper limit is, therefore, less than $10\times10^8$, appropriately less than $7\times10^8$, and preferably, less than $4\times10^8$ Ohm.cm. In order to provide the necessary quantity of electric current for the electrophoretic precipitation, it is necessary to maintain the conductivity of the bath, which is determined by the degree of neutralization of the binder, above 800 $\mu Scm^{-1}$, appropriately, above 1200 $\mu Scm^{-1}$ and preferably above 1600 $\mu Scm^{-1}$.

Both anionic and cationic resins may be used as binders with the anionic binders being preferred for acidic fillers and the cationic resins for basic fillers. The anionic resins, such as maleinized or acrylated butadiene oils, maleinized natural oils, carboxyl group containing epicote esters and acrylate resins, acryl-epoxy resins, unmodified polyesters or polyesters modified with fatty acids, having an acid number of 30 to 180, in particular between 40 and 80, and are at least partially neutralized by ammonia, amines or aminoalcohols. Highly volatile amines are preferred, so that they may be removed as completely as possible during the short baking times (30 sec. to 300 sec.) desired for the film. Ammonia is especially preferred.

Crosslinking is effected either by oxidation with unsaturated double bonds or by thermal reaction with the appropriate crosslinking agents. Suitable crosslinking resins include phenol resins and amineformaldehyde resins. For the preparation of white coatings, catalyzable or self-crosslinking acrylate resins are preferred. For coating with clear compositions, acrylated or maleinized epoxy esters or epoxyacrylates are preferred.

Suitable cationic resins include butadiene oil-aminoalkylines, Mannich bases of phenolic resins, Michael addition products of primary and/or secondary amines and/or alkanolamines of resins with unsaturated double bonds or amino-epoxy resins having an amine number of 30 to 120 mg KOH/g/solid resin, preferably 50 to 90. These resins are at least partially neutralized with organic monocarboxylic acids, such as carboxylic acid, formic acid, acetic acid, lactic acid, etc. As the crosslinking agents, blocked isocyanates or resins containing re-esterifiable ester groups are preferably used.

The binders are partially neutralized with the neutralizing agents and optionally diluted in the presence of solvents with deionized or distilled water. Suitable solvents are primary, secondary and/or tertiary alcohols, ethyleneglycol or propyleneglycol-mono or diethers, diacetone alcohol or lower proportions of solvents not dilutable with water, such as benzene hydrocarbons.

A solvent content as low as possible is desired. Preferably, less than 15% by weight and more preferably less than 5% by weight, are suitable because increasing solvent content has a detrimental effect on the wrap-around.

Solids in the bath are generally between 5 and 30% preferably more than 10% and less than 20% by weight. With rising solids content, the conductivity of the bath increases and the precipitation equivalent (Ampere×sec/g) is reduced, whereby the wrap-around may be increased. Due to the high concentration of layer-forming ions, the layer resistance is thus passing through a maximum.

The temperature of the bath is between 20° and 35° C. With declining temperatures, the wrap-around increases. Temperatures under 20° C. are uneconomical, as the heat generated during the electro-dipcoating must be removed with much cooling water. Temperatures in excess of 35° C., render the control of the bath difficult, as too much solvent is evaporated and certain hydrolysis phenomena produce fluctuations in the electrical data.

The coating medium may contain additional conventional auxiliary materials of the coating industry, such as catalysts, flow agents, antifoaming substances, lubricants, etc. Naturally, the auxiliary substances chosen should not react with the water at the pH value of the bath; should not introduce interfering foreign ions and must not precipitate in an unstirrable form during extended standing periods.

The binders may be used in the pigmented form. Pigments or fillers having small particle size, such as less than 10 $\mu$m and in particular 5 $\mu$m, are readily dispersed in the coating medium. Settled particles of this size may be stirred up, and suitably used. They must not contain interfering foreign ions and must not react chemically with water or the neutralizing agent.

The pigmentation may be both white or colored; white is preferred. With the additional incorporation of interference pigments, it is possible to obtain coatings with metallic effects, such as, for example, aluminum, gold and the like.

The pigments, for example titanium dioxide, are ground in a concentrated grinding medium and then adjusted with additional amounts of the binder to a pigment-binder ratio of approximately 0.1:1 to 0.7:1. The incorporation of pigments increases the wrap-around. In place of pigments, finely pulverized, insoluble resins, such as pulverized polyhydrocarbon resins, epoxy resins or blocked polyisocyanates, may also be used, wherein the quantities added are chosen so that they do not exceed the maximum layer resistance. The binders, the pigment content, solids in the bath, the choice of the neutralizing agent and the degree of neutralization are correlated with the bath temperature, precipitating voltage and deposition time so that in the electro-dipcoating bath complete coating is obtained, which after baking is free of pores inside the can in layer thicknesses of at least 3 μm, preferably at least 4 μm, particularly preferably at least 5 μm and at the most 10 μm, particularly maximally 7 μm.

The electro-dipcoating is effected in an immersion bath. The hollow bodies, for example cans, are closed on one end. The apparatus for holding the hollow bodies may take various configurations. One suitable example is holding with the aid of a magnetic, electromagnetic or mechanical holding device. Another includes holding by vacuum, in a practically vertical position, i.e., the opening on top, below the surface of the electro-dipcoating vessel. The filling of the can is supported by the pumping of additional bath material by means of a filler fitting, which may be in the form of a hollow electrode. Direct current is used as the source of power. The hollow body is connected electrically, as the anode or the cathode, depending on the type of binder by means of the holding device. The counter electrode is as a matter of principle located outside the hollow body in the electro-dipcoating bath. As the result of the wraparound of the coating medium and the precipitation voltage and coating time required for the specific configuration, the can is coated completely, both inside and outside. This process has the advantage that all of the coating is effected in a single process step and, in view of the low mechanical effort required, numerous cans may be coated simultaneously, and suspended adjacent to each other from the hanger.

To support the operation, in particular when high flow velocities are desired, an auxiliary electrode may be introduced additionally in the can. The auxiliary electrode has a shape that is not determined by the can and is on the average less than half in diameter than the can. It is preferably arranged so that it is introduced simultaneously with the can holder into the inside of the can. In order to obtain flowing in the can and thereby improve the quality of the coating, the auxiliary electrode is hollow. By means of this feed line, filtered watering medium is pumped into the can. Nozzles built into the electrophoresis vessel and directed onto the bottom of the can may be used by means of aimed jets of the paint to eliminate gas bubbles from the bottom wall. This also facilitates the coating of the bottom of the can which may be of an inwardly directed arcuate shape.

In a further embodiment of the process, internal coating is effected after the filling of the vertically positioned cans with an inner electrode and outside coating in the conventional manner with a second counter electrode in the electro-dipcoating in the bath. The uncut cans are immersed only far enough so that they are completely coated after cutting. On the other hand, care must be taken so that the edges of the cans are not submerged. This makes it possible to coat initially on the inside and in a further work step in a second electro-dipcoating vessel on the outside with a different paint or coating medium. Coating may also be performed simultaneously with two different media on the inside and the outside.

The cans are emptied by turning them, whereby the bottom of the can arrives on top. During the extraction of the hanger, it is rinsed together with the cans, first with ultrafiltrate and then with water to which an emulsifier has been added to prevent wetting defects. This is followed by the baking of the coating for 1 to 300 seconds at temperatures of 180° to 250° C. The conveyor belt is passed in the process with the hanger and the cans closed through the furnace. In a preferred embodiment, the bottom of the can is predried and provided with a protective auxiliary layer. This may be followed by transfer to a conveyor belt passing through the drying furnace. The opening of the can may be directed downward or preferably upward.

During continuous coating in the electro-dipcoating vessel carboxylic acid accumulates in the case of an anionic binder amine and with a cationic binder. To compensate for this effect, additional filler materials are either neutralized correspondingly to a lesser degree or the excess neutralizing agents are removed by electrodialysis. The rinsing water is concentrated by ultrafiltration and returned to the coating vessel, whereby the degree of utilization of the coating medium is increased and interfering foreign ions are removed.

EXAMPLE 1

An anionic, self-crosslinking acrylate resin according to West German Published Application No. 1,669,107 was partially neutralized with ammonia and diluted with deionized water to a solids content of 15% by weight. A beaded can (diameter 56 mm, length 116 mm) was held by the beaded rim with an electrically conducting clamp and carefully immersed completely in a conducting vessel insulated against grounding, having a diameter of 19 cm and filled with dilute coating medium. The direct current of the source of power was connected with the can and by means of another pole with the outer vessel. Coating was effected with an auxiliary electrode with a diameter of 1 cm, immersed to a depth of 8 cm into the can. After rinsing with water, the can was baked for 3 minutes at 215° C. in a circulating furnace. The can was coated inside and outside completely with a thin and nonporous clear coating. Measured values are compiled in Table 1.

EXAMPLE 2

The binder of Example 1 was pigmented with 0.4 parts by weight of titanium dioxide per 1 part by weight of the binder and after neutralization with ammonia diluted to a solids content of 9% by weight. Coating was effected without an auxiliary electrode. The can was completely coated with a white paint. Porosity, measured in an electrolyte solution at a potential of 4 volts, amounts to 5 mA after 20 seconds. The measured values are set forth in Table 1.

EXAMPLE 3

A cationic amino-epoxy resin according to West German Offenlegungsschrift 3122641 was pigmented with 0.4 parts by weight of a mixture of 99 parts by weight titanium dioxide and 1 part by weight soot and after neutralization with formic acid diluted to a solids content of 15% by weight with deionized water. Coating was performed without an auxiliary electrode. The can was completely covered with a gray paint. The measured values are set forth in Table 1.

TABLE I

| EXAMPLE | 1 | 2 | 3 |
|---|---|---|---|
| Solids | 14.9 by weight-% | 8.7 by weight-% | 14.8 by weight-% |
| pH Value | 8.3 | 8.6 | 5.5 |
| Bath Conductivity | 1977 $\mu Scm^{-1}$ | 940 $\mu Scm^{-1}$ | 1640 $\mu Scm^{-1}$ |
| MEQ Value | 54 | 40 | 45 |
| Bath Temperature | 25° C. | 25° C. | 25° C. |
| Precipitation Time | 16 s | 16 s | 4 s |
| Voltage | 100 Volt | 100 Volt | 240 Volt |
| Amount of Current | 39 Amps | 31 Amps | 25 Amps |
| Coating per can | 792 mg | 895 mg | 663 mg |
| Layer Resistance | $1.0 \cdot 10^8$ Ohm · cm | $1.3 \cdot 10^8$ Ohm · cm | $3.9 \cdot 10^8$ Ohm · cm |

What is claimed is:

1. A process for coating hollow bodies having an open side and a closed bottom by electrodeposition of a coating composition comprising:

vertically immersing said hollow bodies into an electro-dipcoating bath containing coating medium with the bottom directed downwardly into said bath;

filling the inside of said hollow bodies from above with the coating medium;

coating the inside and outside of said hollow bodies by electrodeposition; and removing the coated hollow bodies from the electro-dipcoating bath with said open side directed downwardly.

2. The process of claim 1 wherein said coated hollow bodies are tilted in said electro-dipcoating bath prior to said removal step.

3. The process of claim 1 wherein said coated hollow bodies are tilted during said removal step.

4. The process of claim 1 wherein said hollow bodies are forcibly immersed with their opening below the surface of said bath in said filling step.

5. The process of claim 1 wherein said hollow bodies are filled with the bath liquid in said filling step.

6. The process of claim 5 wherein said hollow bodies are passed through said bath in an incompletely submerged state so that their opening remains located above the surface of said coating medium.

7. The process of claim 1 wherein said hollow bodies are transported by a transport element.

8. The process of claim 1 wherein said transport element is an endless conveyor belt.

9. The process of claim 1 wherein said transport element is an endless chain.

10. The process of claim 1 wherein said hollow bodies comprise a plurality of cans transported simultaneously through the electro-dipcoating bath.

11. The process of claim 10 wherein said cans are connected by means of a transport element as the anode in the case of coating with an anionic electro-dipcoating paint and by means of a transport element as the cathode in the case of coating with a cationic electro-dipcoating paint.

12. The process of claim 11, wherein said cans are moved by the transport element through said bath and through a drying furnace.

13. The process of claim 1 wherein said coating composition is a synthetic resin composition selected from the group consisting of anionic and cationic coating resins.

14. The process of claim 13 wherein said coating composition contains additional electrodeposition compatible pigments, fillers, catalysts and/or other conventional coating adjuvants.

* * * * *